US005954038A

United States Patent [19]

Warwick et al.

[11] Patent Number: 5,954,038

[45] **Date of Patent: *Sep. 21, 1999**

[54] COMBUSTION FACE INSERT

[75] Inventors: Michael J. Warwick, Columbus; James W. Patten, Hope; Martin R. Myers, Columbus; Paul C. Becker, Bloomington; Yong Ching Chen, Columbus, all of Ind.

[73] Assignee: Cummins Engine Company, Inc., Columbus, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/922,022

[22] Filed: Sep. 2, 1997

[51] Int. Cl.[6] ..... F02F 1/26

[52] U.S. Cl. ..... 123/668

[58] Field of Search ..... 123/668, 669, 123/193.3, 193.5

[56] References Cited

U.S. PATENT DOCUMENTS

| | | | |
|---|---|---|---|
| 1,857,077 | 5/1932 | Adamson | 123/669 |
| 2,926,649 | 3/1960 | Hicks | 123/668 |
| 3,081,754 | 3/1963 | Georges | 123/668 |
| 3,115,127 | 12/1963 | Spencer et al. | 123/669 |
| 3,459,167 | 8/1969 | Briggs et al. | 123/669 |
| 4,344,390 | 8/1982 | Heydrick et al. | 123/669 |
| 4,494,501 | 1/1985 | Ludovico | 123/668 |
| 4,537,161 | 8/1985 | Huret et al. | 123/668 |
| 4,774,926 | 10/1988 | Adams | 123/668 |

*Primary Examiner*—Marguerite McMahon
*Attorney, Agent, or Firm*—Sixbey, Friedman, Leedom & Ferguson, P.C.

[57] ABSTRACT

A combustion face insert is provided for connection to a bottom wall of an aluminum cylinder head adjacent a combustion chamber in an internal combustion engine which includes an insert body formed of a material having a predetermined hardness. The insert body includes a lower surface facing the combustion chamber and extending radially outwardly to form an outer peripheral extent having a predetermined size necessary to cause the lower surface to be positioned for engagement with an annular combustion seal to effectively seal the combustion chamber. This design allows a greater power density to be achieved in a heavy duty diesel engine utilizing an aluminum cylinder head, increases the thermal fatigue resistance of the valve bridge area and increases the resistance of an aluminum cylinder head to indentation by the combustion seal of the head gasket during deflection of the aluminum cylinder head. Hardened valve seats, which include either a hardened portion of the insert body or a hardened valve seat insert connected to the insert body, are positioned around intake and exhaust openings formed in the insert body for sealing abutment by respective intake and exhaust valves.

8 Claims, 3 Drawing Sheets

COMBUSTION FACE INSERT

BACKGROUND OF THE INVENTION

1. Technical Field

The present invention relates to an insert for forming a combustion face of an aluminum cylinder head. More particularly, the present invention relates to a combustion face insert which increases the thermal fatigue resistance in the valve bridge area as well as the residual hardness in the combustion seal area of the aluminum cylinder head in a heavy duty diesel engine.

2. Background Art

In an internal combustion engine, the combustion chambers are defined in general by the inner walls of the cylinder, by the face of a piston reciprocally mounted within the cylinder, and by the combustion face of a cylinder head closing the cylinder. A combustion seal, often formed of hard material such as steel, is typically positioned within a head gasket compressively positioned between the cylinder head and an upper face of the cylinder walls/engine block. In heavy duty diesel engines, the pressures developed in the combustion chamber during the compression and power strokes of the piston are very high, causing the cylinder head to deflect relative to the upper face of the cylinder walls/engine block at the combustion seal. Relative movement between the cylinder head and the steel combustion seal may cause indentations in the cylinder head at the combustion face if the cylinder head is not formed of a material having a sufficient hardness. Moreover, extremely high temperatures are also created in the cylinder head during the compression and power strokes. As a result, high thermal stresses are produced in the valve bridge area between the intake and exhaust valve ports. In addition, the valve bridge area is subject to deformation due to pressure forces created in the combustion chamber. Therefore, the valve bridge area of the cylinder head around the intake and exhaust valve ports must have an increased resistance to wear, thermal fatigue, and deformation, and the area of the cylinder head around the combustion seal must retain a high residual hardness to prevent indentation by the combustion seal during deflection of the cylinder head.

There have been numerous attempts at increasing the thermal resistance of the cylinder head in the valve bridge area. U.S. Pat. No. 4,337,736 to Rasch et al. discloses a cast iron cylinder head having a preformed workpiece of a thermal fatigue-resistant alloy material metallically bonded to the cylinder head around the valve bridge area to provide reinforcement in this area. This reinforcement provides absorption of the high stresses occurring in the valve bridge area between the valves due to thermal stresses and high pressures resulting from the combustion event. Since most cast iron cylinders heads, such as the one disclosed in Rasch et al, possess a high residual hardness in the area of the cylinder head around the combustion seal, the cast iron cylinder heads do not need further reinforcement in the area adjacent to the combustion seal due to the inherent properties of iron which are sufficient to prevent indentation of the head during deflection of the cylinder head. However, cast iron has a high density undesirably resulting in a extremely heavy cylinder head.

In order to advantageously lighten the weight of an engine, it is known to use aluminum alloys, in place of iron, to form the cylinder head. However, aluminum alloys do not have the required resistance to wear, thermal fatigue, and deformation experienced in the area of the cylinder head surrounding the intake and exhaust ports by the high temperatures and pressures produced during combustion. Therefore, an aluminum cylinder head must be reinforced in the valve bridge area to provide the necessary resistance to wear and thermal fatigue around the intake and exhaust ports. U.S. Pat. No. 4,487,175 to Krczal discloses an example of such reinforcement, where a layer of hardened aluminum is formed on the bottom surface of an aluminum cylinder head, including the area between the intake and exhaust ports, to increase the resistance of the aluminum cylinder head to thermal shock. However, hardened aluminum may not be sufficiently resistant to wear and thermal fatigue during exposure to the extremely high temperatures and pressures generated in heavy duty diesel engines in combination with the repeated contact of the intake and exhaust valves with their respective valve seats. It is often necessary to use a separate hardened valve seat insert formed of a material having properties capable of withstanding such extreme conditions in the valve seat areas. Also, aluminum, and even hardened aluminum, may not possess the requisite residual hardness necessary to prevent indentation by the combustion seal. This indentation of the aluminum cylinder head will diminish the integrity of the seal around the combustion chamber.

Accordingly, for an engine having an aluminum cylinder head, an insert must be provided over the combustion face of the cylinder head having specific properties for providing increased resistance to wear and thermal fatigue around the intake and exhaust ports of the cylinder head as well as retaining a high residual hardness in the area adjacent the combustion seal to prevent indentations during deflection of the cylinder head. U. S. Pat. Nos. 4,519,359 and 4,524,732 to Dworak et al. disclose providing a thermal insulation layer on the combustion face of a cylinder head, where a steel valve seat is formed in the thermal insulation layer around the intake and exhaust valves. The Dworak et al. patents disclose an insert covering the combustion face of a cylinder head having different material properties around the intake and exhaust ports from the properties provided in the area adjacent the cylinder walls. However, the thermal insulation layer used in the Dworak et al. patents prevent the formation of heat bridges due to its low thermal conductivity. Specifically, covering the surface of the combustion face of the cylinder head with a thermal insulation layer will prevent the high temperatures generated in the combustion chamber from passing through to the cylinder head. This insulating effect will lead to a temperature build-up in the combustion chamber, which can increase the thermal stress on the components surrounding the combustion chamber and lead to the formation of cracks in these components. In order to prevent a temperature build-up in the combustion chamber, it is necessary to utilize an insert having high thermal conductivity in the area covering the combustion face of the cylinder head, so that heat from the combustion chamber can pass through the insert, into the cylinder head for absorption by a cooling fluid.

In view of the foregoing, there is clearly a need for an insert positioned on the combustion face of an aluminum cylinder head which increases the thermal fatigue resistance of the valve bridge area in the aluminum cylinder head, which increases the resistance of the aluminum cylinder head to indentation from the combustion seal of the head gasket, and which has hardened valve seats surrounding the intake and exhaust valve ports which resist wear. There is further a need for an insert positioned on the combustion face of an aluminum cylinder head which accomplishes these results while dissipating the heat from the combustion chamber through the insert into the cylinder head.

SUMMARY OF THE INVENTION

It is an object of the present invention to overcome the aforementioned shortcomings associated with the prior art.

Another object of the present invention is to provide a combustion face insert for covering the combustion face of an aluminum cylinder head adjacent to a combustion chamber in a diesel engine.

A further object of the present invention is to provide a combustion face insert for covering the combustion face of an aluminum cylinder head which increases the power density achievable in the diesel engine.

Yet another object of the present invention is to provide a combustion face insert which increases the thermal fatigue resistance of the valve bridge area between the intake and exhaust valve ports in an aluminum cylinder head.

It is a further object of the present invention to provide a combustion face insert which increases the resistance of an aluminum cylinder head to indentation or fretting from the force subjected by the combustion seal of a head gasket against the cylinder head during deflection of the aluminum cylinder head in a combustion stroke of the engine.

It is yet another object of the present invention to provide a combustion face insert which provides wear-resistant valve seats surrounding the intake and exhaust ports in an aluminum cylinder head.

Still a further object of the present invention is to provide a combustion face insert formed of a thermally conductive material, which may be ferrous or non-ferrous.

It is yet a further object of the present invention to provide a combustion face insert having the above-described objects and advantages by forming the insert of a ferrous material or non-ferrous thermal fatigue resistant materials, such as nickel alloys or cobalt-based alloys.

These as well as additional objects and advantages of the present invention are achieved by providing a combustion face insert for connection to a bottom wall of an aluminum cylinder head, having intake and exhaust ports, adjacent to a combustion chamber in an internal combustion engine. The combustion face insert of the present invention includes an insert body formed of a material having a predetermined hardness. The insert body includes a lower surface facing the combustion chamber and extends radially outwardly to form an outer peripheral extent. The outer peripheral extent has a predetermined size necessary to cause the lower surface to be positioned for engagement with an annular combustion seal to effectively seal the combustion chamber. The insert body includes intake and exhaust openings for alignment with the intake and exhaust ports, respectively, of the aluminum cylinder head. These openings may be formed prior to, or after the insert is bonded to the head. Valve seats are positioned around the intake and exhaust openings in the insert body for sealing abutment by respective intake and exhaust valves. The intake and exhaust valve seats are formed of a hard material having a wear resistance sufficient for heavy duty diesel engines. The intake valve and exhaust valve seats may include a hardened portion of the insert body or a hardened valve seat insert connected to the insert body.

DETAILED DESCRIPTION OF THE PREFERRED EMBODIMENT

Figure 1:
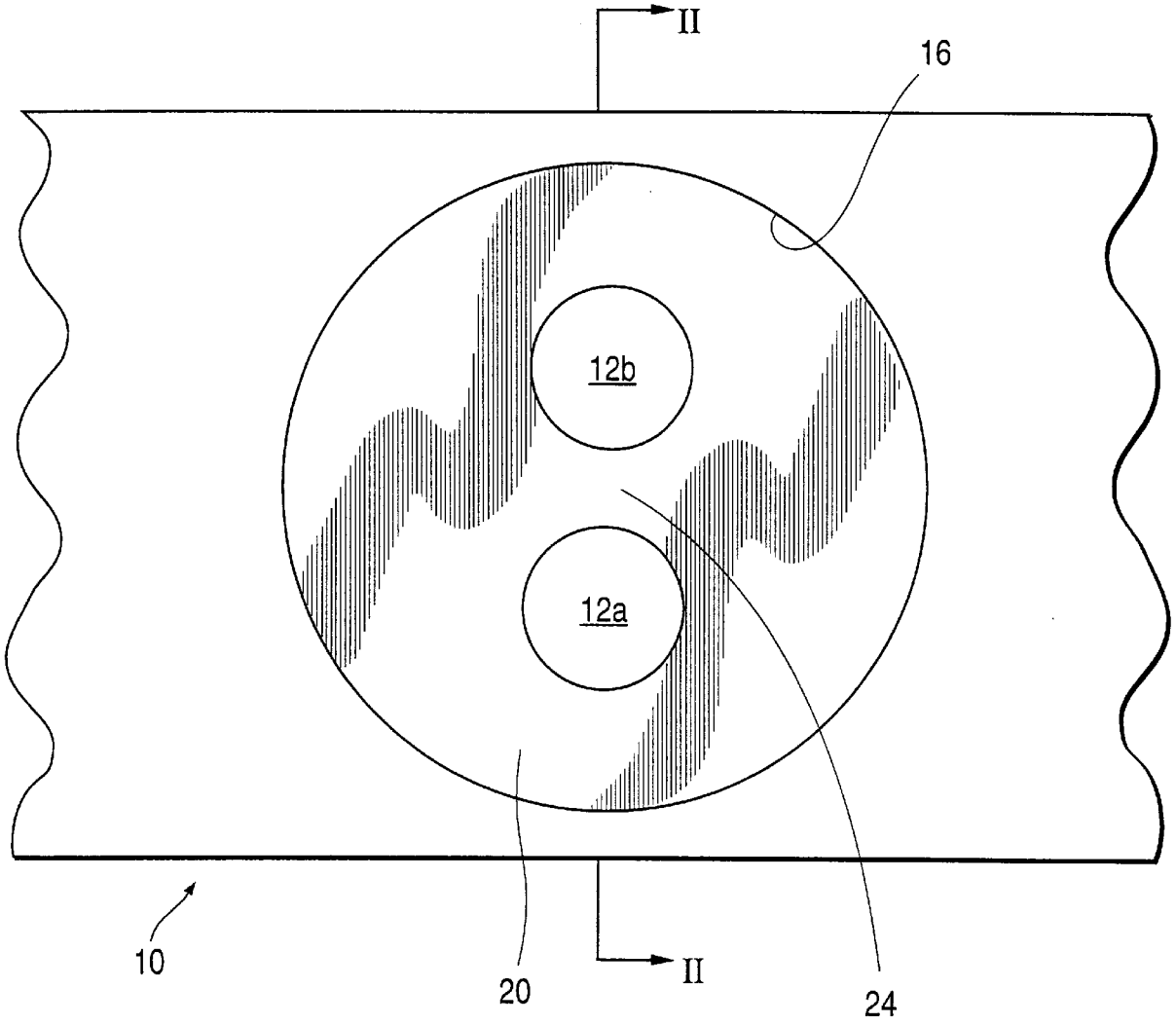
FIG. 1 is a bottom view of a portion of the aluminum cylinder head having a combustion face insert positioned thereon in accordance with the preferred embodiment of the present invention, and the valve openings machined in the insert.
Figure 2:
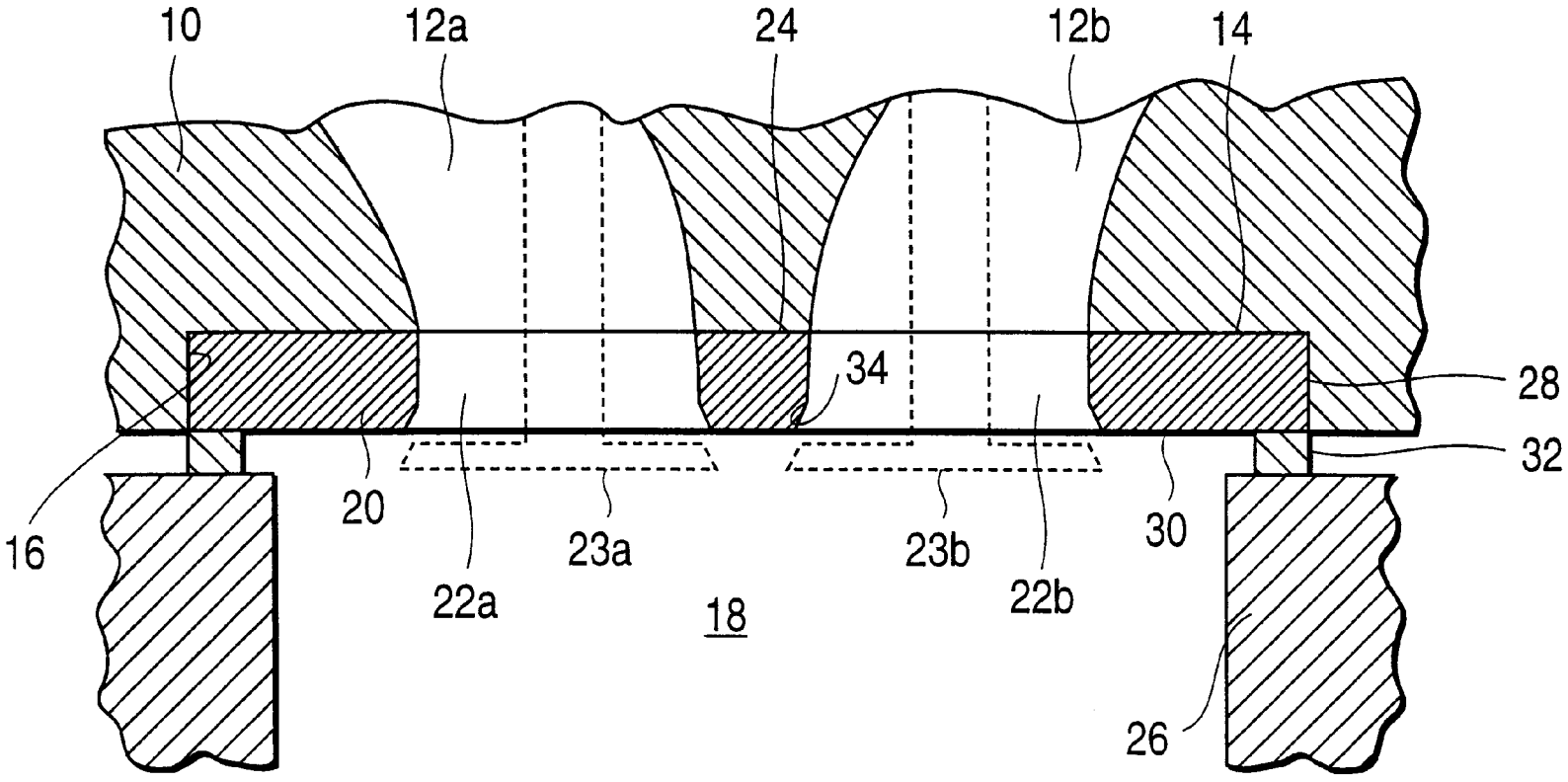
FIG. 2 is a cross-sectional view of the aluminum cylinder head of FIG. 1 taken generally along line II—II.

Referring now to FIGS. 1 and 2, a cylinder head 10 for a heavy duty diesel engine is illustrated having an intake port 12*a* and an exhaust port 12*b* formed in the cylinder head 10, where the cylinder head 10 is formed from aluminum or an aluminum alloy. Cylinder head 10 is securely mounted on an engine block which includes cylinder walls 26 forming a combustion chamber 18. Aluminum cylinder head 10 includes a recess 16 formed adjacent to combustion chamber 18. A combustion face insert 20 is positioned in recess 16 against an inner surface 14 of the aluminum cylinder head 10 for minimizing wear and thermal fatigue while ensuring an effective combustion seal between the aluminum cylinder head 10 and the engine block during all operating conditions of the heavy duty diesel engine.

An intake opening 22*a* and an exhaust opening 22*b* are formed in the combustion face insert 20 for alignment with the intake and exhaust ports 12*a* and 12*b*, respectively, in aluminum cylinder head 10. These openings may be formed prior to, or after, bonding insert 20 to the head. Accordingly, combustion face insert 20 will completely surround intake port 12*a*, exhaust port 12*b*, and a valve bridge area 24 in the portion of the aluminum cylinder head 10 between the intake port 12*a* and the exhaust port 12*b*. The insert 20 extends radially outwardly such that its outer periphery 28 extends beyond the outer periphery of the combustion chamber 18. The outer periphery has a predetermined size necessary to allow a lower surface 30 of the combustion face insert 20 to be positioned for engagement with an annular combustion seal 32 situated against the cylinder walls 26 around the combustion chamber 18. While recess 16 and combustion face insert 20 are illustrated as being circular in shape, it is understood that recess 16 and combustion face insert 20 may be formed with any shape which completely covers combustion chamber 18 while allowing combustion face insert 20 to engage combustion seal 32. The intake opening 22*a* and exhaust opening 22*b* may be outwardly tapered at the lower surface 30 of the combustion face insert 20 to provide valve seats 34 surrounding openings 22*a* and 22*b* for sealing abutment with respective intake and exhaust valves 23*a* and 23*b*.

The cylinder head 10 is formed from aluminum or an aluminum alloy in order to substantially decrease the weight of the engine compared to conventional cast iron cylinder heads. However, the temperatures and resultant thermal stresses generated in the combustion chamber 18 of a heavy duty diesel engine often may exceed the thermal fatigue resistance of aluminum casting alloys, especially around the intake and exhaust ports in the cylinder head. Further, the high cylinder pressures in heavy duty diesel engines cause the cylinder head to deflect during the combustion stroke, which can lead to fretting or indentation of the aluminum cylinder head by a steel combustion seal surrounding the combustion chamber due to aluminum alloys being softer than that of the steel combustion seal. Accordingly, when using an aluminum alloy to form the cylinder head 10, it is necessary to position a combustion face insert 20 on the aluminum cylinder head 10, in the area forming the combustion chamber, which has a thermal fatigue resistance great enough to withstand thermal stresses while also having a residual hardness which resists fretting or indentation of the aluminum cylinder head 10 by the annular combustion seal 32 during deflection of the head due to cylinder pressure forces cyclically acting on the head.

In order to provide a combustion face having these properties, the combustion face insert 20 of the present invention is preferably formed of a ferrous material, such as gray iron due to its high thermal conductivity. Excessive thermal stresses in the components surrounding the combustion chamber 18, which may result from the high temperatures generated during combustion, can lead to damage and cracking of these components. Therefore, the ferrous material forming the combustion face insert 20 has a thermal fatigue resistance greater than the resulting thermal stresses generated. Additionally, ferrous materials, especially gray iron, are good conductors of heat, so that the ferrous combustion face insert 20 of the present invention assists in dissipating the heat generated in the combustion chamber 18 by allowing the heat to pass through the combustion face insert 20 and into the aluminum cylinder head 10 for absorption by a cooling fluid and dissipation to the environment. Thus, the ferrous combustion face insert 20 allows the aluminum cylinder head 10 to dissipate heat from the combustion chamber 18, while providing a surface adjacent to the combustion chamber 18 having a high thermal fatigue resistance. Further, gray iron and other similar ferrous materials have a high residual hardness, so that the ferrous combustion face insert 20 is resistant to fretting or indentation which can result from relative movement between aluminum cylinder head 10 and steel combustion seal 32 as the aluminum cylinder head 10 deflects during the compression and power strokes. While the combustion face insert 20 is described as being formed of a ferrous material, the combustion face insert 20 may also be formed from non-ferrous materials having high thermal fatigue resistance and adequate thermal conductivity, such as nickel alloys, cobalt-based alloys, or aluminumbased metal matrix composites.

The combustion face insert 20 may be attached to the aluminum cylinder head 10 by any joining technique sufficient to create a strong metallurgical bond at the interface between combustion face insert 20 and aluminum cylinder head 10. Such joining techniques may include, for example, welding, brazing, diffusion bonding, casting-in-place, or other similar joining techniques.

In a heavy duty diesel engine utilizing an aluminum cylinder head having an unprotected combustion face adjacent to the combustion chamber, the power density within the engine must be limited to prevent the aluminum from becoming soft and cracking due to the high temperatures resulting from an excessive power density. Accordingly, combustion face insert 20 of the present invention protects the combustion face 14 of the aluminum cylinder head 10 and allows the engine to operate at increased power densities. Thus, the combustion face insert 20 allows the power of an engine utilizing an aluminum cylinder head 10 to be increased.

Figure 3:
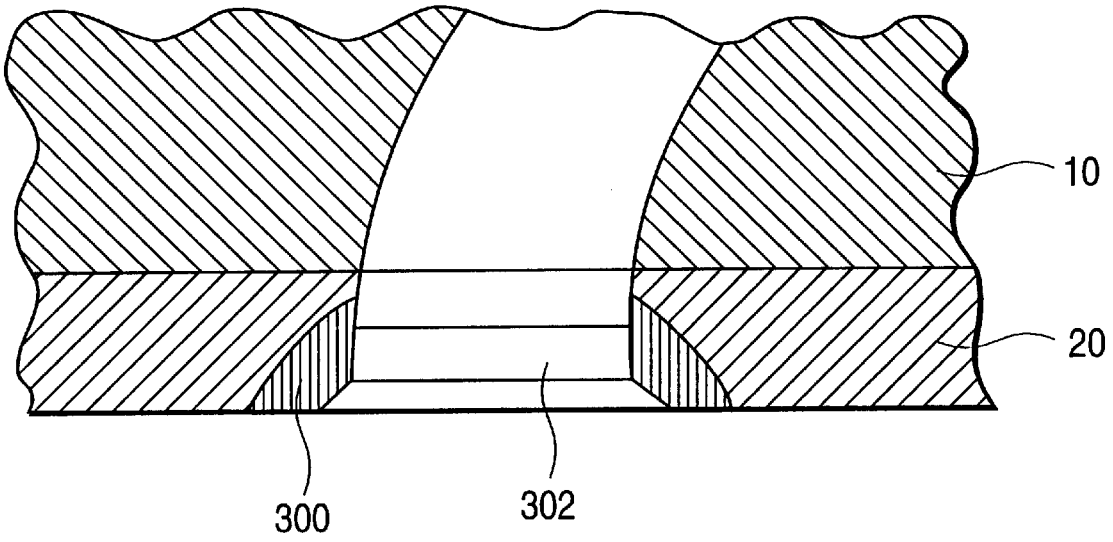
FIG. 3 is a cross-sectional view of the aluminum cylinder head having the combustion face insert positioned thereon in accordance with another preferred embodiment of the present invention.
Figure 4:
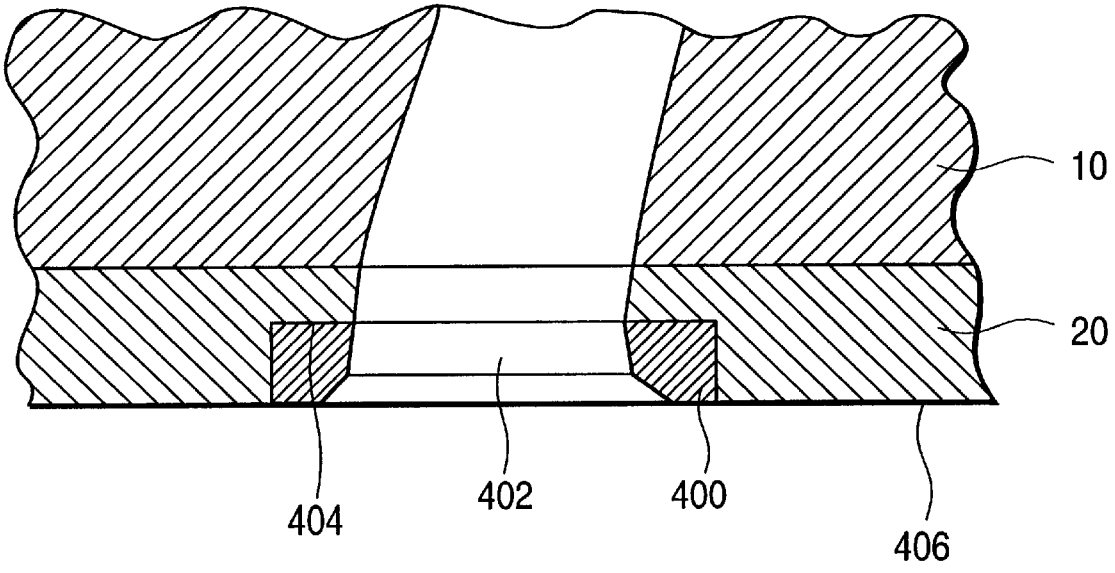
FIG. 4 is a cross-sectional view of the aluminum cylinder head having the combustion face insert positioned thereon in accordance with yet another preferred embodiment of the present invention.

In combination with the high thermal stresses produced in the valve bridge area 24 of the aluminum cylinder head 10, the repeated contact between the valve seats 34 and the intake and exhaust valves 23*a* and 23*b* during their opening and closing can tend to wear away the valve seats 34 over time. Therefore, an alternative preferred embodiment of the present invention, as shown in FIG. 3, provides a valve seat 300 in the combustion face insert 20 having a resistance to wear greater than the wear resistance of the ferrous material forming the combustion face insert 20. In this embodiment, the portion of the combustion face insert 20 surrounding the opening 302 (either the intake opening or exhaust opening) in the combustion face insert 20 is quenched and tempered to produce a hardened, wear-resistant valve seat 300 capable of withstanding the extreme conditions in the valve seat area due to its increased hardness and wear resistance. The valve seat 300 may be hardened by induction hardening or other hardening techniques to produce a martensitic matrix in the area of ferrous insert 20 forming valve seat 300. The valve seat 300 provides a wear-resistant surface having a hardness greater than the remaining portions of the combustion face insert 20. Accordingly, the use of a ferrous material in forming the combustion face insert 20 allows a valve seat 300 to be formed in the combustion face insert 20 having the requisite hardness to withstand wear without requiring the use of a separate valve seat insert to be positioned in the combustion face insert 20 around the opening 302.

In yet another embodiment of the present invention, a separate valve seat insert 400 may be positioned around the opening 402 in the combustion face insert 20 for either the intake port 12*a* or exhaust port 12*b*. The valve seat insert 400 is formed from a material having a wear-resistant surface for the respective valve. The valve seat insert 400 possesses a greater resistance to wear than the wear resistance of the ferrous material forming the combustion face insert 20. The valve seat insert 400 is positioned within a recess 404 formed in a lower surface 406 of the combustion face insert 20 around the opening 402. The valve seat insert 400 may be affixed to the combustion face insert 20 in any manner, including a press-fit connection into the recess 404. The use of a ferrous material in forming the combustion face insert 20 allows for a more secure press-fit to be achieved when pressing the valve seat insert 400 in place than possible with the base aluminum, because the ferrous material will be more closely matched to the hardened material forming the valve seat insert 400 for residual stress allowing a greater press-fit to be achieved. The valve seat insert 400 may be formed from hard ferrous materials, or other wear resistant materials, such as nickel alloys, cobalt alloys, cemented carbides or ceramics.

As can be seen from the foregoing, the ferrous combustion face insert 20 formed in accordance with the present invention allows a greater power density to be achieved in a heavy duty diesel engine utilizing an aluminum cylinder head. Moreover, the ferrous combustion face insert 20 formed in accordance with the present invention increases the thermal fatigue resistance of the valve bridge area in an aluminum cylinder head of a heavy duty diesel engine. Furthermore, the ferrous combustion face insert 20 formed in accordance with the present invention increases the resistance of an aluminum cylinder head to indentation by the combustion seal of the head gasket during deflection of the aluminum cylinder head. Additionally, the ferrous combustion face insert 20 formed in accordance with the present invention provides an induction hardenable valve seat material in an aluminum cylinder head as well as providing a secure anchor for hardened valve seat inserts.

We claim:

1. A combustion face insert for connection to a bottom wall of an aluminum cylinder head, having intake and exhaust ports, adjacent a combustion chamber in an internal combustion engine, comprising:

an insert body formed of a material with a high thermal fatigue resistance and high thermal conductivity having a predetermined hardness, said insert body material including one of gray iron and a non-ferrous, non-aluminum material, said insert body including intake and exhaust openings for alignment with the intake and exhaust ports, respectively, of the aluminum cylinder head, said insert body including a lower surface facing the combustion chamber and extending radially outwardly to form an outer peripheral extent, said outer peripheral extent having a predetermined size necessary to cause said lower surface to be positioned for engagement by an annular combustion seal to effectively seal the combustion chamber; and an intake valve seat surrounding said intake opening and an exhaust valve seat surrounding said exhaust opening for sealing abutment by respective intake and exhaust valves, said intake and exhaust valve seats having a greater wear resistance than said insert body.

2. The combustion face insert of claim 1, wherein each of said intake valve and said exhaust valve seats includes a hardened portion of said material forming said insert body.

3. The combustion face insert of claim 1, wherein each of said intake valve and said exhaust valve seats includes a valve seat insert connected to said insert body.

4. The combustion face insert of claim 3, wherein said intake and exhaust valve seat inserts are each formed of a hard, wear-resistant material sufficient to resist wear in a heavy duty diesel engine.

5. A cylinder head for positioning on an internal combustion engine block to form an end wall of at least one combustion chamber formed in the block, wherein an annular combustion seal is positioned in an interface between the cylinder head and the engine block surrounding the combustion chamber, comprising:

a cylinder head body formed of an aluminum alloy, said cylinder head body including a bottom surface facing the combustion chamber, an intake port formed in said bottom surface for delivering intake air to the combustion chamber and an exhaust port formed in said bottom surface for directing exhaust gas from the combustion chamber;

a combustion face insert formed of a material with a high thermal fatigue resistance and high thermal conductivity having a predetermined hardness and connected to said bottom surface of said cylinder head body, said combustion face insert material including one of gray iron and a non-ferrous, non-aluminum material, said combustion face insert including intake and exhaust openings positioned in alignment with said intake and exhaust ports, respectively, of the aluminum cylinder head body, said combustion face insert including a lower surface facing the combustion chamber and extending radially outwardly to form an outer peripheral seal portion for sealingly abutting the annular combustion seal around the entire combustion chamber to effectively seal the combustion chamber; and an intake valve seat surrounding said intake opening and an exhaust valve seat surrounding said exhaust opening for sealing abutment by respective intake and exhaust valves, said intake and exhaust valve seats having a hardness and wear resistance sufficient to resist wear in a heavy duty diesel engine.

6. The combustion face insert of claim 5, wherein each of said intake valve and said exhaust valve seats includes a hardened portion of said material forming said combustion face insert.

7. The combustion face insert of claim 5, wherein each of said intake valve and said exhaust valve seats includes a valve seat insert connected to said combustion face insert.

8. The combustion face insert of claim 7, wherein said intake and said exhaust valve seat inserts are each formed of a hard, wear-resistant material sufficient to resist wear in a heavy duty diesel engine.

* * * * *